US006550930B1

(12) United States Patent
Portouche

(10) Patent No.: US 6,550,930 B1
(45) Date of Patent: Apr. 22, 2003

(54) WRIST MOUNTED ILLUMINATION APPARATUS

(76) Inventor: Gene Portouche, 19 A Maley Avenue, London SEZ7-9BY (GB)

( * ) Notice: Subject to any disclaimer, the term of this patent is extended or adjusted under 35 U.S.C. 154(b) by 0 days.

(21) Appl. No.: 09/881,882

(22) Filed: Jun. 15, 2001

(51) Int. Cl.[7] ..... F21V 21/08

(52) U.S. Cl. ..... 362/103; 362/109; 362/191; 362/200; 362/269; 362/285; 362/287

(58) Field of Search ..... 362/103, 109, 362/116, 110, 190, 191, 200, 201, 208, 269, 285, 287, 296, 310, 311, 329

(56) References Cited

U.S. PATENT DOCUMENTS

| | | | | |
|---|---|---|---|---|
| 1,923,962 | A | | 8/1933 | Worley |
| 3,112,889 | A | | 12/1963 | Marmo et al. |
| 4,521,832 | A | | 6/1985 | Barbour |
| 4,788,631 | A | | 11/1988 | Fuller |
| 4,910,652 | A | | 3/1990 | Rhine |
| D361,143 | S | | 8/1995 | Helvey |
| 5,568,971 | A | * | 10/1996 | Jewell ..... 362/103 |
| 6,213,619 | B1 | * | 4/2001 | Yu ..... 362/103 |

* cited by examiner

*Primary Examiner*—Sandra O'Shea
*Assistant Examiner*—Ronald E. Delggizzi

(57) ABSTRACT

A wrist mounted illumination apparatus for providing illumination in front of a user. The wrist mounted illumination apparatus includes a housing having a front wall. A peripheral wall is integrally coupled to and extends away from the front wall. A back wall is removably securable to the peripheral wall. The front wall has a window therein. A substantially transparent covering is positioned over the window. An intermediate wall is positioned in the housing and defines a cavity between the window and a remaining portion of the housing. The intermediate wall has a reflective side directed towards the window. A light bulb is positioned in the cavity. A power supply for powering the light bulb is positioned in the housing and is electrically coupled to the light bulb. A first actuator selectively turns the light bulb on. The first actuator is electrically coupled to the power supply. A securing member removably secures a strap to the wrist for positioning around the wrist of a user. A hinge hingedly couples the housing to the strap.

7 Claims, 6 Drawing Sheets

WRIST MOUNTED ILLUMINATION APPARATUS

BACKGROUND OF THE INVENTION

1. Field of the Invention

The present invention relates to flashlights and more particularly pertains to a new wrist mounted illumination apparatus for providing illumination in front of a user.

2. Description of the Prior Art

The use of flashlights is known in the prior art. More specifically, flashlights heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,788,631; 4,910,652; 4,521,832; 1,923,962; 3,112,889; and U.S. Des. Patent No. 361,143.

While these devices fulfill their respective, particular objectives and requirements, the aforementioned patents do not disclose a new wrist mounted illumination apparatus. The inventive device includes a housing having a front wall. A peripheral wall is integrally coupled to and extends away from the front wall. A back wall is removably securable to the peripheral wall. The front wall has a window therein. A substantially transparent covering is positioned over the window. An intermediate wall is positioned in the housing and defines a cavity between the window and a remaining portion of the housing. The intermediate wall has a reflective side directed towards the window. A light bulb is positioned in the cavity. A power supply for powering the light bulb is positioned in the housing and is electrically coupled to the light bulb. A first actuator selectively turns the light bulb on. The first actuator is electrically coupled to the power supply. A securing member removably secures a strap to the wrist for positioning around the wrist of a user. A hinge hingedly couples the housing to the strap.

In these respects, the wrist mounted illumination apparatus according to the present invention substantially departs from the conventional concepts and designs of the prior art, and in so doing provides an apparatus primarily developed for the purpose of providing illumination in front of a user.

SUMMARY OF THE INVENTION

In view of the foregoing disadvantages inherent in the known types of flashlights now present in the prior art, the present invention provides a new wrist mounted illumination apparatus construction wherein the same can be utilized for providing illumination in front of a user.

The general purpose of the present invention, which will be described subsequently in greater detail, is to provide a new wrist mounted illumination apparatus and method which has many of the advantages of the flashlights mentioned heretofore and many novel features that result in a new wrist mounted illumination apparatus which is not anticipated, rendered obvious, suggested, or even implied by any of the prior art flashlights, either alone or in any combination thereof.

To attain this, the present invention generally comprises a housing having a front wall. A peripheral wall is integrally coupled to and extends away from the front wall. A back wall is removably securable to the peripheral wall. The front wall has a window therein. A substantially transparent covering is positioned over the window. An intermediate wall is positioned in the housing and defines a cavity between the window and a remaining portion of the housing. The intermediate wall has a reflective side directed towards the window. A light bulb is positioned in the cavity. A power supply for powering the light bulb is positioned in the housing and is electrically coupled to the light bulb. A first actuator selectively turns the light bulb on. The first actuator is electrically coupled to the power supply. A securing member removably secures a strap to the wrist for positioning around the wrist of a user. A hinge hingedly couples the housing to the strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrist mounted illumination apparatus and method which has many of the advantages of the flashlights mentioned heretofore and many novel features that result in a new wrist mounted illumination apparatus which is not anticipated, rendered obvious, suggested, or even implied by any of the prior art flashlights, either alone or in any combination thereof.

It is another object of the present invention to provide a new wrist mounted illumination apparatus which may be easily and efficiently manufactured and marketed.

It is a further object of the present invention to provide a new wrist mounted illumination apparatus which is of a durable and reliable construction.

An even further object of the present invention is to provide a new wrist mounted illumination apparatus which is susceptible of a low cost of manufacture with regard to both materials and labor, and which accordingly is then susceptible of low prices of sale to the consuming public, thereby making such wrist mounted illumination apparatus economically available to the buying public.

Still yet another object of the present invention is to provide a new wrist mounted illumination apparatus which provides in the apparatuses and methods of the prior art some of the advantages thereof, while simultaneously overcoming some of the disadvantages normally associated therewith.

Still another object of the present invention is to provide a new wrist mounted illumination apparatus for providing illumination in front of a user.

Yet another object of the present invention is to provide a new wrist mounted illumination apparatus which includes a housing having a front wall. A peripheral wall is integrally coupled to and extends away from the front wall. A back wall is removably securable to the peripheral wall. The front wall has a window therein. A substantially transparent covering is positioned over the window. An intermediate wall is positioned in the housing and defines a cavity between the window and a remaining portion of the housing. The intermediate wall has a reflective side directed towards the window. A light bulb is positioned in the cavity. A power supply for powering the light bulb is positioned in the housing and is electrically coupled to the light bulb. A first actuator selectively turns the light bulb on. The first actuator is electrically coupled to the power supply. A securing member removably secures a strap to the wrist for positioning around the wrist of a user. A hinge hingedly couples the housing to the strap.

Still yet another object of the present invention is to provide a new wrist mounted illumination apparatus that allows a person to work under the illumination of a small hand held light while keeping the hands of the user free to work.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
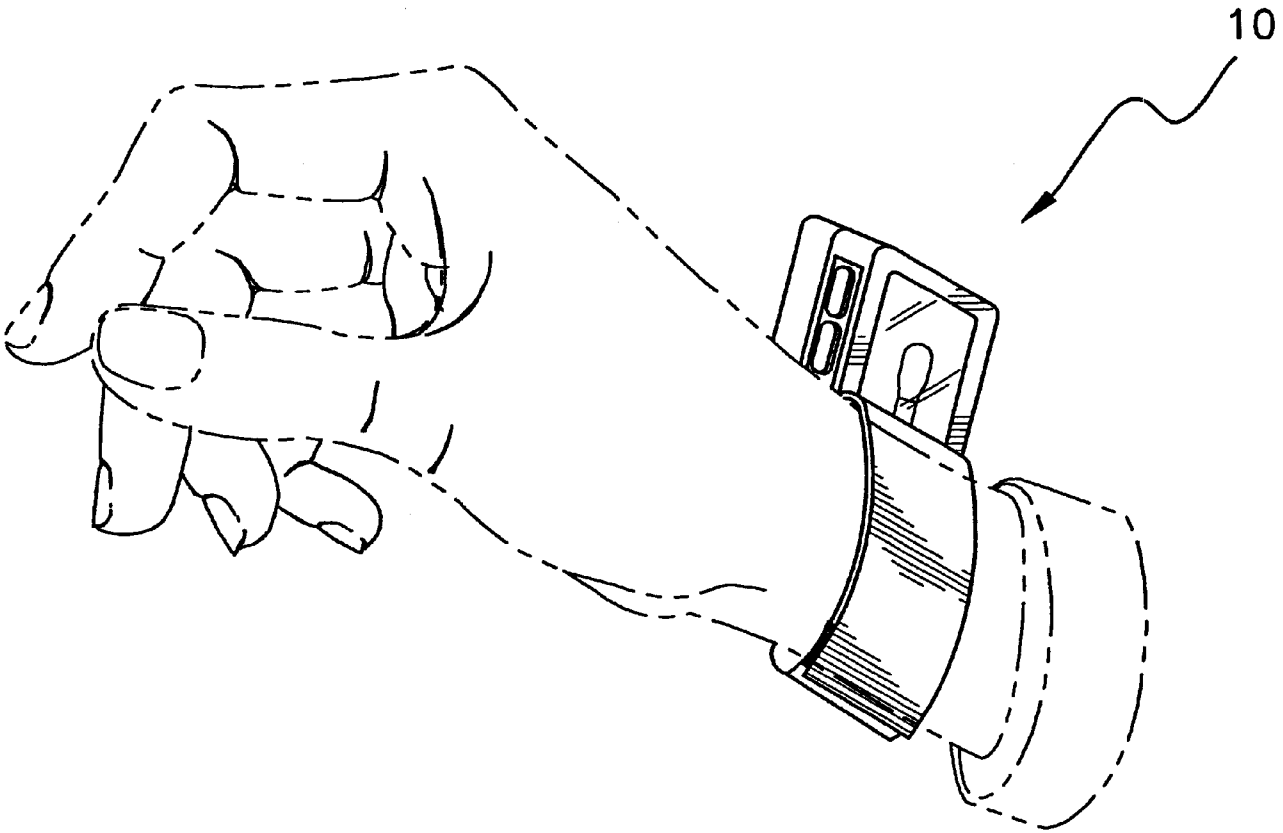
FIG. 1 is a schematic perspective view of the first embodiment of a new wrist mounted illumination apparatus according to the present invention.
Figure 2:
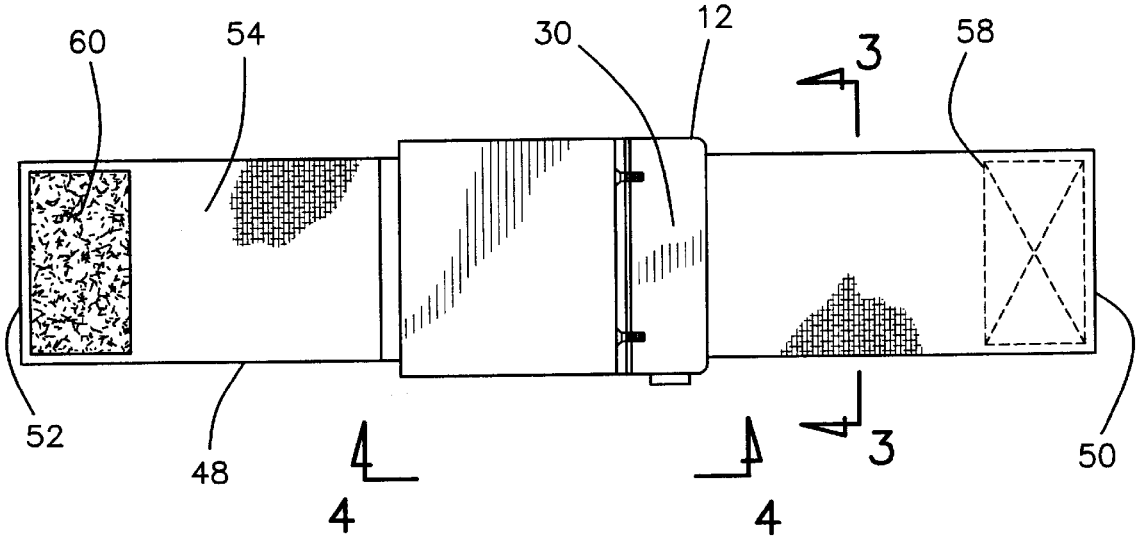
FIG. 2 is a schematic top view of the present invention.
Figure 3:
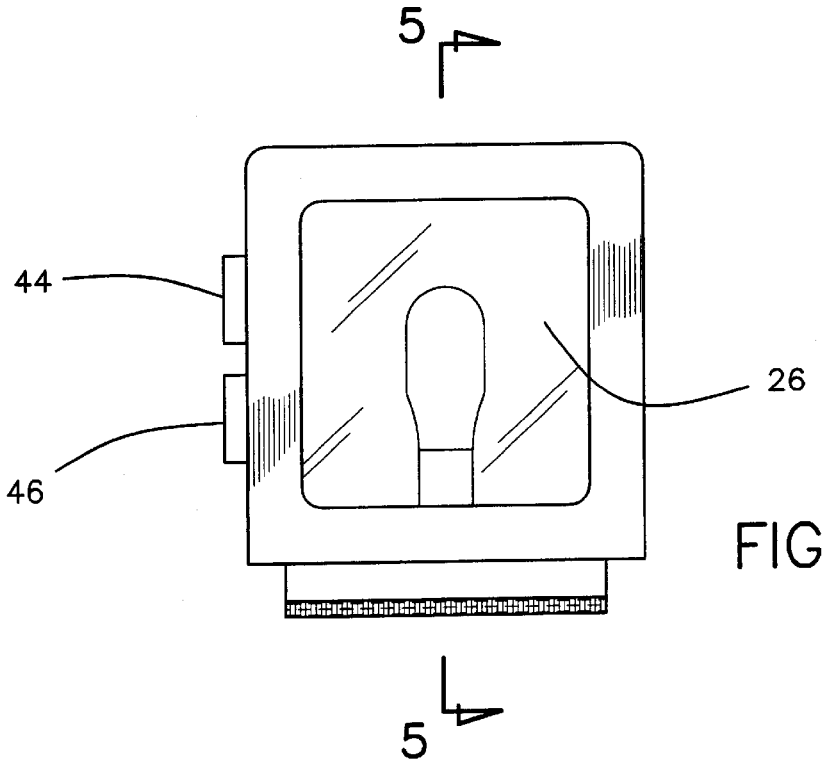
FIG. 3 is a schematic front view taken along line 3—3 of the present invention.
Figure 4:
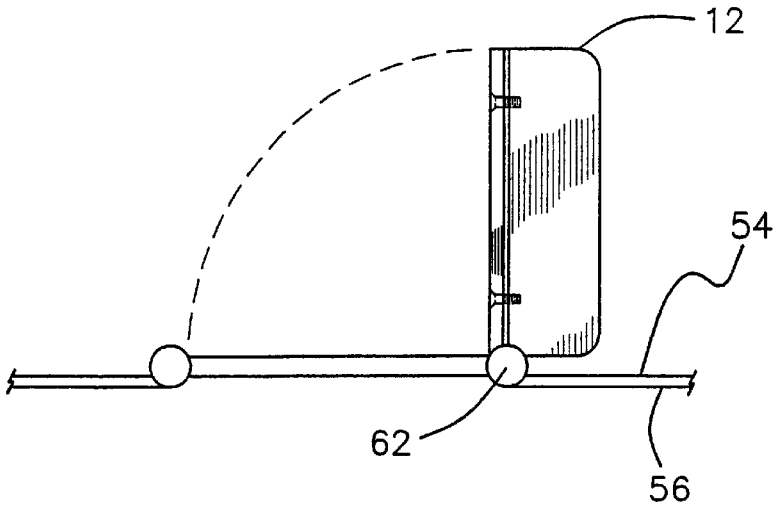
FIG. 4 is a schematic side view taken along line 4—4 of the present invention.
Figure 5:
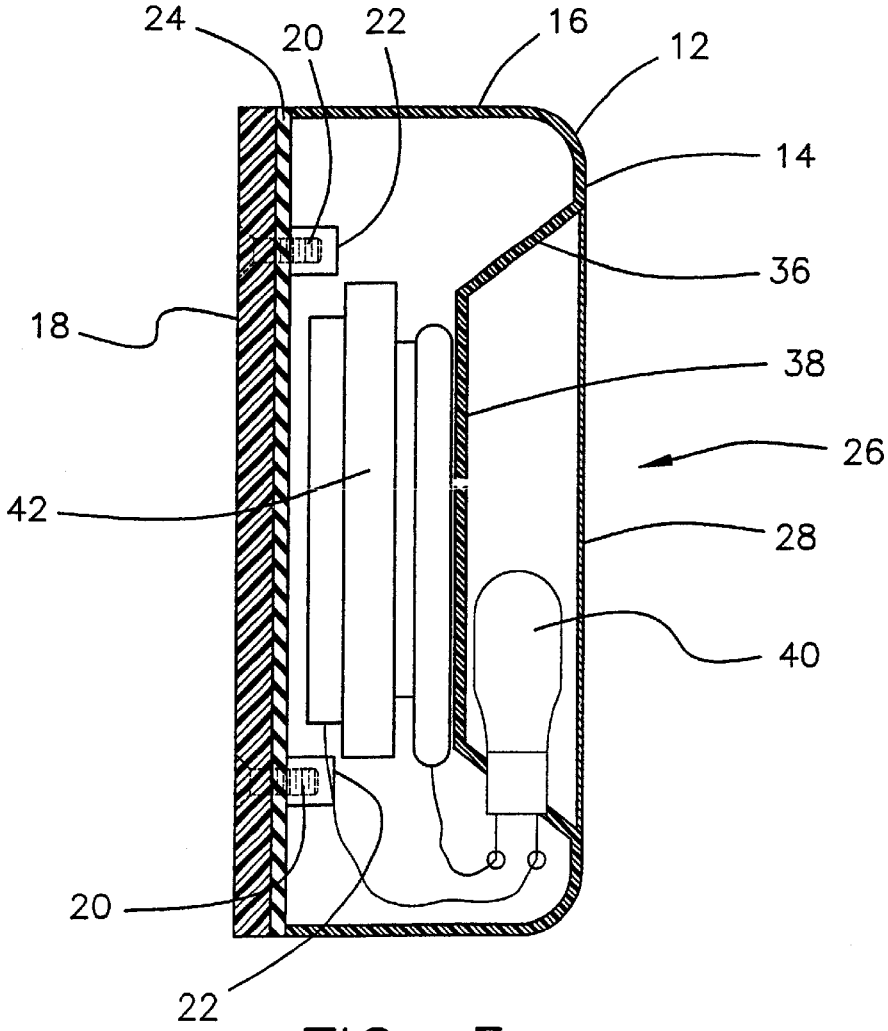
FIG. 5 is a schematic cross-sectional view taken along line 5—5 of the present invention.
Figure 6:
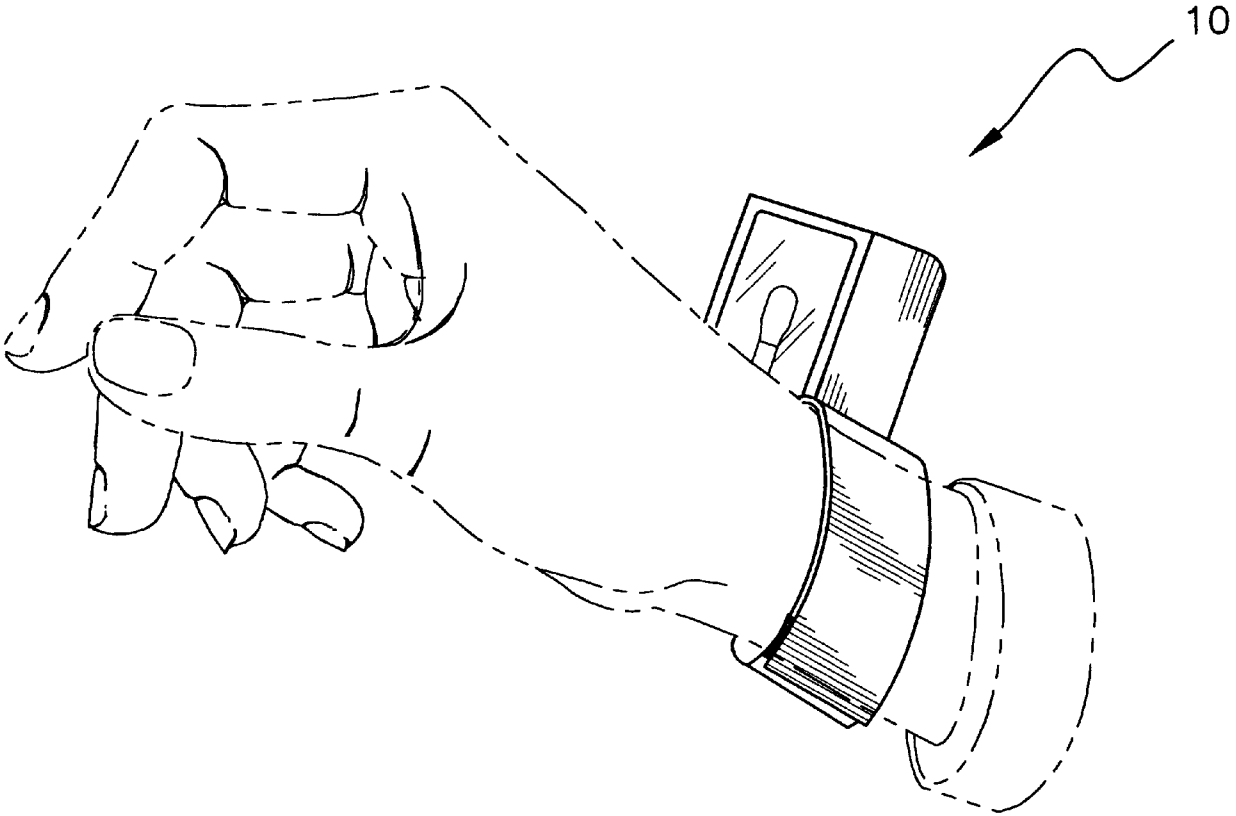
FIG. 6 is a schematic perspective view of the second embodiment of the present invention.
Figure 7:
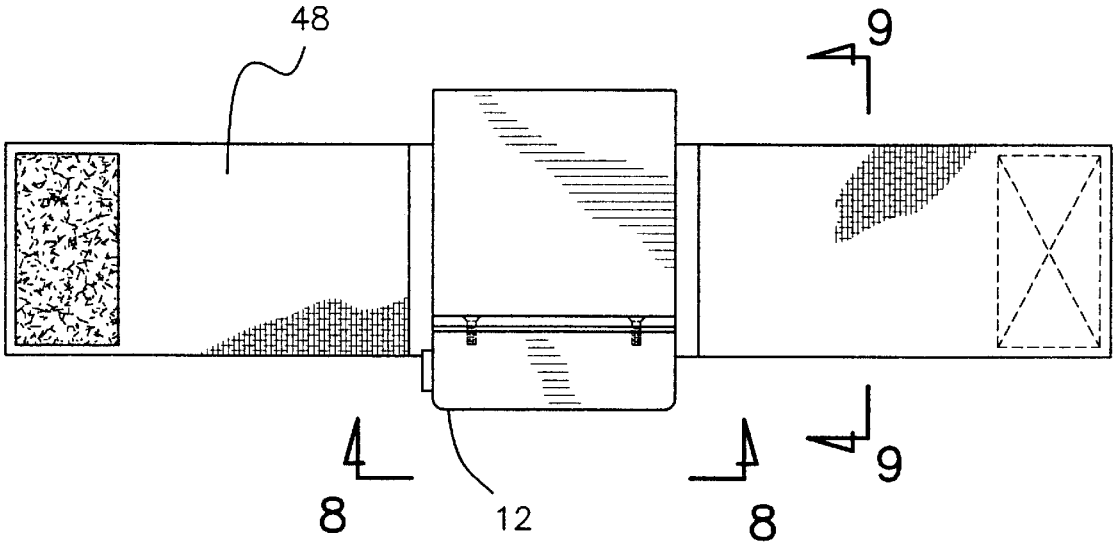
FIG. 7 is a schematic top view of the present invention.
Figure 8:
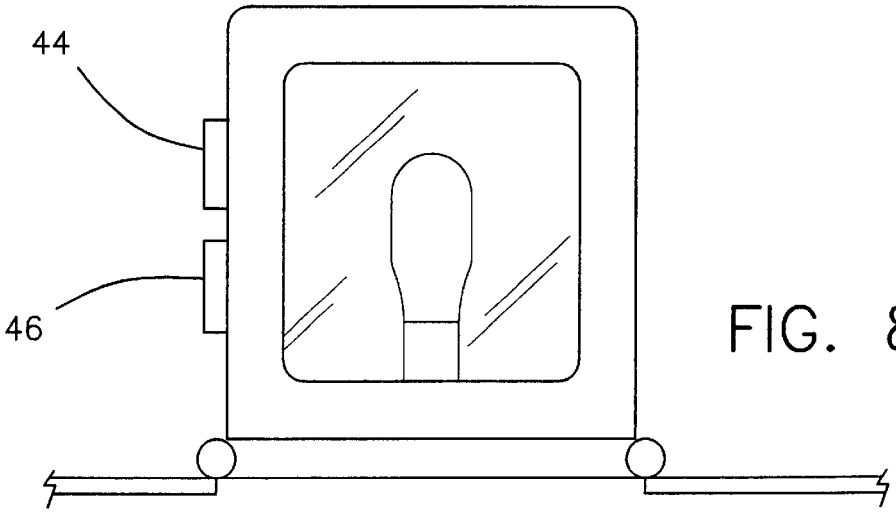
FIG. 8 is a schematic side view taken along line 8—8 of the present invention.
Figure 9:
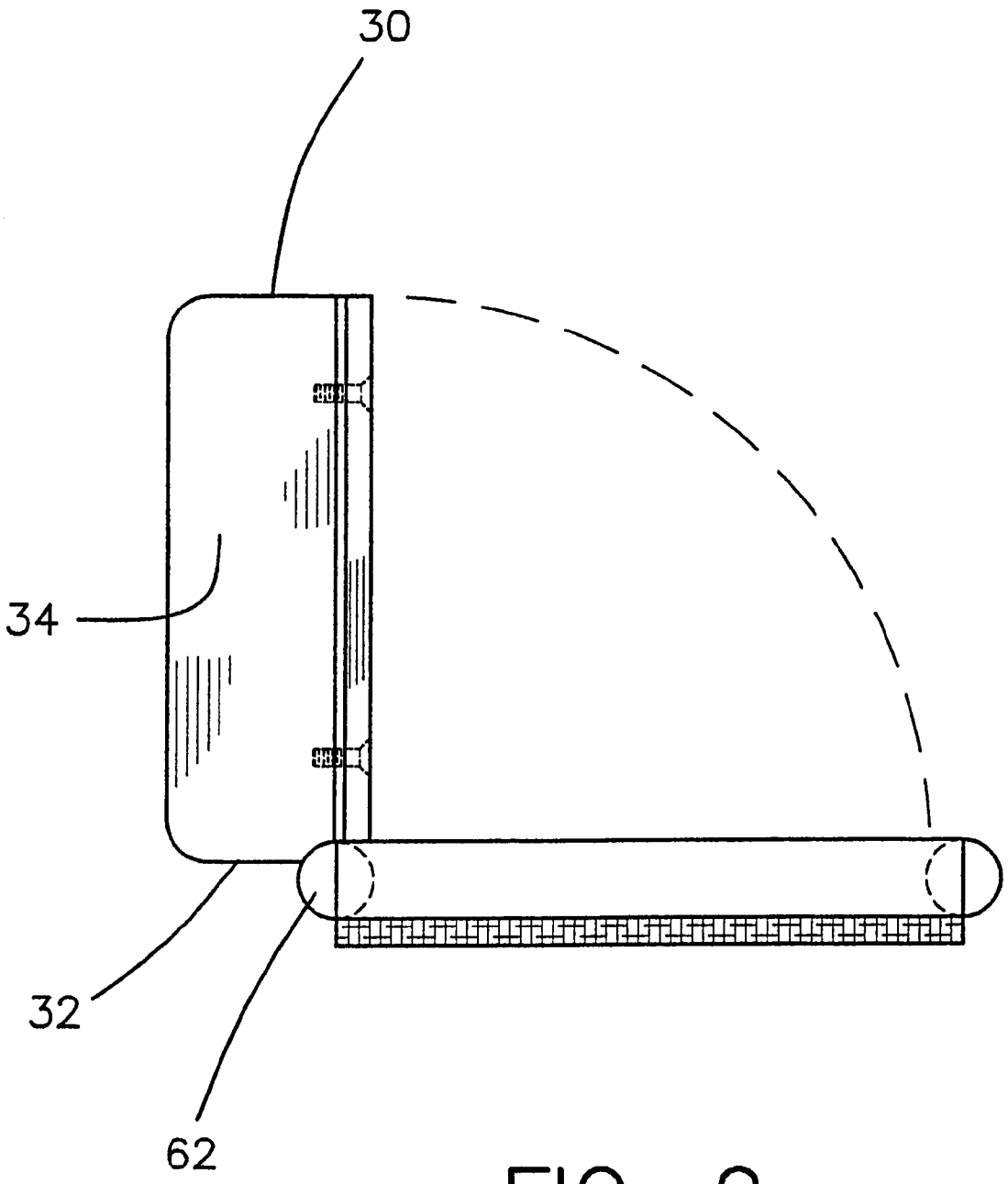
FIG. 9 is a schematic front view taken along line 9—9 of the present invention.

With reference now to the drawings, and in particular to FIGS. 1 through 9 thereof, a new wrist mounted illumination apparatus embodying the principles and concepts of the present invention and generally designated by the reference numeral 10 will be described.

As best illustrated in FIGS. 1 through 9, the wrist mounted illumination apparatus 10 generally comprises a housing 12 having a front wall 14. A peripheral wall 16 is integrally coupled to and extends away from the front wall 14. A back wall 18 is removably securable to the peripheral wall 16 by a plurality of fasteners 20 extending through the back wall 18 and threadably engages an associated bracket 22 mounted on the peripheral wall 16. A seal 24 is positionable between the back wall 18 and the peripheral wall 14 such that the housing 12 is substantially watertight. The front wall 14 has a window 26 therein. A substantially transparent covering 28 is positioned over the window 26 and is substantially watertight. The peripheral wall 18 includes a top wall 30, a bottom wall 32, and a pair of lateral side-walls 34.

An intermediate wall 36 is positioned in the housing 12 and defines a cavity between the window 26 and a remaining portion of the housing 12. The intermediate wall 36 has a reflective side 38 directed towards the window 26.

A light bulb 40 is positioned in the cavity. A power supply 42 for powering the light bulb 40 is positioned in the housing 12. The power supply 42 is electrically coupled to the light bulb 40, and preferably comprises a battery.

A first actuator 44 for selectively turning the light bulb 40 on is electrically coupled to the power supply 42. The first actuator 44 comprises a button positioned on the peripheral wall 16.

A second actuator 46 for selectively turning the light bulb off is electrically coupled to the power supply 42. The second actuator 46 comprises a button positioned on the peripheral wall 16.

A strap 48 for positioning around the wrist of a user is elongated has a first end 50, a second end 52, a top surface 54 and a bottom surface 56.

A securing member removably secures the strap 48 to the wrist. The securing member comprises a hook and loop securing means having a hook portion 58 securely attached to the bottom surface 56 of the strap and positioned generally adjacent to the first end 50 and a loop portion 60 securely attached to the top surface 54 of the strap 48 and positioned generally adjacent to the second end 52.

A hinge 62 for hingedly coupling the housing 12 to the strap 48 is positioned generally between the first 50 and second 52 ends of the strap 48. The hinge 62 is securely coupled to the strap 48 and a juncture of the peripheral wall 18 and back wall 18 such that the back wall 18 may be abutted against the strap 48. Ideally, the hinge 62 is positioned along an edge of the strap 48 and orientated generally parallel to a line extending between the first 50 and second 52 ends of the strap such that the light bulb may forward when worn on the wrist of a user, as shown in FIGS. 6–9. Alternatively, the hinge 62 may be orientated parallel to the line extending between said first 50 and second 52 ends as shown in FIGS. 1–5.

In use, the device is used as flashlight with the ability to shine light forward in front of a user's hand. This allows a person to use their hands in the dark while using a light in a non-obtrusive or awkward manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrist mounted illumination device for removably mounting on a wrist of a user comprising:

a housing, said housing having a front wall, a peripheral wall being integrally coupled to and extending away from said front wall, a back wall being removably securable to said peripheral wall, said front wall having a window therein, a substantially transparent covering being positioned over said window and being substantially watertight for inhibiting environmentally communication between and interior of said housing and an exterior: through said window;

an intermediate wall being positioned in said housing and defining a cavity between said window and a remaining portion of said housing, said intermediate wall having a reflective side directed towards said window;

a light bulb being positioned in said cavity;

a power supply for powering said light bulb being positioned in said housing and electrically coupled to said light bulb;

a first actuator for selectively turning said light bulb on, said first actuator being electrically coupled to said power supply;

a strap for positioning around the wrist of a user;

a securing member removably securing said strap to said wrist; and a hinge hingedly coupling said housing to said strap.

2. The wrist mounted illumination device as in claim 1, wherein a seal is positionable between said back wall and said peripheral wall such that said housing is substantially watertight.

3. The wrist mounted illumination device as in claim 1, further including:

a second actuator for selectively turning said light bulb off, said second actuator being electrically coupled to said power supply, said second actuator comprising a button positioned on said peripheral wall.

4. The wrist mounted illumination device as in claim 1, wherein, said strap being elongated having a first end, a second end, a top surface and a bottom surface, said securing member comprising a hook and loop securing means having a hook portion securely attached to said bottom surface of said strap and positioned generally adjacent to said first end and a loop portion securely attached to said top surface of said strap and positioned generally adjacent to said second end.

5. The wrist mounted illumination device as in claim 1, wherein said hinge is positioned generally between said first and second ends of said strap, said hinge being securely coupled to said strap and a juncture of said peripheral wall such that said back wall may be abutted against said strap, said hinge being positioned along an edge of said strap and orientated generally parallel to a line extending between said first and second ends of said strap such that said light bulb may shine forward when worn on the wrist of a user.

6. The wrist mounted illumination device as in claim 1, wherein said hinge is positioned generally between said first and second ends of said strap, said hinge being securely coupled to said strap and a juncture of said peripheral wall such that said back wall may be abutted against said strap, said hinge being orientated generally perpendicular to a line extending between said first and second ends of said strap such that said light bulb may shine forward when worn on the wrist of a user.

7. A wrist mounted illumination device for removably mounting on a wrist of a user comprising:

a housing, said housing having a front wall, a peripheral wall being integrally coupled to and extending away from said front wall, a back wall being removably securable to said peripheral wall by a plurality of fasteners extending through said back wall and threadably engaging an associated bracket mounted on said peripheral wall, a seal being positionable between said back wall and said peripheral wall such that said housing is substantially watertight, said front wall having a window therein, a substantially transparent covering being positioned over said window and being substantially watertight for inhibiting environmentally communication between and interior of said housing and an exterior through said window, said peripheral wall including a top wall, a bottom wall, and a pair of lateral side walls;

an intermediate wall being positioned in said housing and defining a cavity between said window and a remaining portion of said housing, said intermediate wall having a reflective side directed towards said window;

a light bulb being positioned in said cavity;

a power supply for powering said light bulb being positioned in said housing, said power supply being electrically coupled to said light bulb, said power supply comprising a battery;

a first actuator for selectively turning said light bulb on, said first actuator being electrically coupled to said power supply, said first actuator comprising a button positioned on said peripheral wall;

a second actuator for selectively turning said light bulb off, said second actuator being electrically coupled to said power supply, said second actuator comprising a button positioned on said peripheral wall;

a strap for positioning around the wrist of a user, said strap being elongated having a first end, a second end, a top surface and a bottom surface;

a securing member removably securing said strap to said wrist, said securing member comprising a hook and loop securing means having a hook portion securely attached to said bottom surface of said strap and positioned generally adjacent to said first end and a loop portion securely attached to said top surface of said strap and positioned generally adjacent to said second end;

a hinge for hingedly coupling said housing to said strap, said hinge being positioned generally between said first and second ends of said strap, said hinge being securely coupled to said strap and a juncture of said peripheral wall such that said back wall may be abutted against said strap, said hinge being positioned along an edge of said strap and orientated generally parallel to a line extending between said first and second ends of said strap such that said light bulb may shine forward when worn on the wrist of a user.

* * * * *